US005271112A

United States Patent [19]

Bible et al.

[11] Patent Number: 5,271,112

[45] Date of Patent: Dec. 21, 1993

[54] ELASTIC BED RUFFLE

[75] Inventors: Susan J. Bible, Shepardsville; Frank N. Preston; Michael E. Seago, both of Louisville, all of Ky.

[73] Assignee: Louisville Bedding, Co., Louisville, Ky.

[21] Appl. No.: 60,646

[22] Filed: May 13, 1993

[51] Int. Cl.[5] ..... A47C 21/00

[52] U.S. Cl. ..... 5/493; 5/482

[58] Field of Search ..... 5/482, 493, 496, 497, 5/499, 500, 502, 485, 486

[56] References Cited

U.S. PATENT DOCUMENTS

| | | | |
|---|---|---|---|
| 2,183,828 | 12/1939 | Trubitz | 155/182 |
| 2,763,875 | 9/1956 | Piontkowski | 5/333 |
| 2,789,292 | 4/1957 | Budinquest | 5/496 X |
| 3,570,026 | 3/1971 | Allison | 5/496 X |
| 3,999,233 | 12/1976 | Morris | 5/493 |
| 4,141,097 | 2/1979 | Levinsohn et al. | 5/493 |
| 4,386,439 | 6/1983 | Reccograndi et al. | 5/493 X |
| 4,734,947 | 4/1988 | Vitale | 5/493 |
| 4,807,316 | 2/1989 | Whipple | 5/493 |
| 4,962,546 | 10/1990 | Vitale | 5/497 |
| 4,980,941 | 1/1991 | Johnson, III | 5/497 |
| 4,985,953 | 1/1991 | Seago | 5/497 |
| 5,003,655 | 4/1991 | Kafai | 5/496 |
| 5,056,441 | 10/1991 | Seago | 112/2.1 |
| 5,127,115 | 7/1992 | Williams et al. | 5/497 |

*Primary Examiner*—Michael F. Trettel

*Attorney, Agent, or Firm*—Banner, Birch, McKie & Beckett

[57] ABSTRACT

A decorative bed ruffle is capable of installation on a mattress foundation such as a box spring without removal of an upper mattress therefrom. A band of elastically stretchable material forms a closed loop adapted to be stretched to pass over the upper mattress and grippingly retained on the sides of the mattress foundation. The width of the band is such-that top and bottom edge portions of the band will extend over and elastically grip top and bottom edge 5 of the mattress foundation, respectively. A decorative skirt is attached to the band of material in overlapping relation therewith, for covering at least part of a central portion of the band extending over the foundation sidewalls, and at least part of the space between the mattress foundation and a supporting floor surface. In addition to easing installation, the inventive bed ruffle provides greater retention on the foundation, permits adjustment of the skirt drop to accommodate different height bed frames and foundations, and can accommodate a range of mattress sizes and shapes.

9 Claims, 3 Drawing Sheets

ELASTIC BED RUFFLE

BACKGROUND OF THE INVENTION

The present invention relates to decorative bed ruffles, and in particular to retaining structures for retaining a decorative bed ruffle securely on a mattress foundation such as a box spring.

Conventional bed ruffles comprise a ruffled skirt secured such as by stitching to the perimeter of a top fabric panel which extends across and completely covers the top of a mattress foundation. (As used herein, mattress foundation refers to the lower component of a two-piece mattress set, e.g., a box spring or rigid support platform, upon which a soft upper mattress is supported.) To install or remove a conventional bed ruffle, it is generally necessary to remove the upper mattress from the foundation so that the top panel of the bed ruffle can be properly placed on the foundation with the ruffled skirt hanging downwardly to cover the foundation sides and the space therebelow. Removal of the upper mattress for this purpose is difficult because of the great size and weight of the mattress.

Conventional bed ruffles are also subject to easy inadvertent displacement from their proper position, e.g., when the bed is made. The top panel lies loosely across the top of the mattress foundation such that it does not adequately prevent movement of the bed ruffle. When sheets and blankets are tucked between the mattress and the foundation, the ruffled skirt may be pulled up with a portion being tucked between the mattress and box spring. Consequently, the bedmaker has a readjust the bed ruffle.

Another limitation of the conventional bed ruffle design is that it does not allow for adjustments of the vertical length of the ruffled skirt, in order to accommodate varying heights of bed frames or foundations. Due to the top panel construction, any attempt to pull the skirt downwardly on one side will result in an unacceptable shortening of the skirt on the opposite side.

Yet another shortcoming of the conventional bed ruffle design exists from a marketing standpoint. Conventional constructions require the retailer to carry separate inventory for each size of bed, e.g., twin, full, queen and king, since the size of the ruffle is fixed by the size of the top fabric panel. A greater selection of bed ruffle colors and styles could be offered in the same space if a single bed ruffle could be made to fit more than one bed size. Such adaptability would also obviously benefit the user in that the same ruffle could be used on different bed sizes, and the manufacturer in that production requirements would be simplified.

Various alternatives to the conventional bed ruffle construction have been proposed, but none have attained widespread acceptance.

U.S. Pat. No. 3,999,233 to Morris discloses a dust (bed) ruffle wherein a ruffle material depends from the bottom edge of a continuous side panel serving to cover a sidewall of a box spring. Attached along a top edge of the side panel and extending inwardly over a perimetric edge portion of the box spring is an elastic top panel defining a central opening in the dust ruffle. The elastic panel is expandable to enable passage of the dust ruffle over a top mattress, whereby the dust ruffle may be installed on the box spring without removal of the top mattress. This design facilitates the installation and removal of the bed ruffle as compared with the conventional design. However, a number of shortcomings remain.

In particular, the design does not allow for vertical adjustment of the ruffle to accommodate different bed frame and foundation heights. The elastic top panel has mitred corners for accommodating the four corners of the box spring. As a result, the elastic top panel extends inwardly from each side panel side to form a discrete perimetric support platform having a fixed width. This construction defines a fixed perimetric edge or corner which must be aligned with the upper edge of the box spring. As a result, the length of the depending ruffle material cannot be varied. Additionally, the mitred corners limit the dust ruffle to a particular shape of box spring.

Furthermore, the stretchability of the Morris dust ruffle would not allow the dust ruffle to be applied to multiple mattress sizes, e.g., twin and full or queen and king. Rather, Morris teaches the provision of elasticity merely for enabling the dust ruffle to pass over the upper mattress and then grip the box spring.

Another shortcoming of the Morris dust ruffle pertains to the attachment location of the ruffle material. In Morris, the ruffle material depends from the lower edge of the side panel. As a result, the lower edge of the side panel cannot extend underneath the bottom edge of the box spring to be secured between the bed frame and the box spring. Additionally, this attachment location requires that the side panel be formed with aesthetics in mind, since it will be wholly exposed. As a result, the gripping characteristics of the side panel may be compromised in the interest of aesthetics, or vice-versa.

U.S. Pat. No. 2,763,875 to Piontkowski discloses a bed ruffle comprising decorative valence panels which are detachable from a separate cover which is installed over the top and sides of a box spring. This design only eliminates the need for removal of the upper mattress in order to remove or install the separate valences. It is still necessary to remove the upper mattress in order to install or remove the box spring cover to which the valences are attached. The other drawbacks of the conventional construction are likewise not adequately addressed. Furthermore, the construction is complicated due to the use of multiple fabric pieces and fastener structures.

U.S. Pat. No. 4,141,097 to Levinsohn et al discloses a dust ruffle having elasticized seams for improving the retention of the dust ruffle on a box spring. The skirt or flounce of the dust ruffle depends from a narrow top portion overlying a perimetric portion of the box spring, whereby material savings are achieved over the conventional structure having a top panel extending entirely across the box spring. While perhaps capable of exhibiting improved retention, this design would not overcome the other identified deficiencies of the conventional structure.

U.S. Pat. No. 4,807,316 to Whipple discloses a split dust ruffle capable of being wrapped around the perimeter of a box spring. Interlining strips are tucked between the mattress and box spring around the perimeter of the box spring. The ends of the dust ruffle are secured together at the head of the bed by tying or otherwise securing the ends of a strip tape attached along the interlining strips. This design obviates the requirement of removing the upper mattress in order to install or remove the dust ruffle, but does not adequately address the other shortcomings of the conventional design.

SUMMARY OF THE INVENTION

In view of the foregoing, it is a principal object of the present invention to provide a bed ruffle construction that overcomes the aforementioned shortcomings of the conventional bed ruffle design.

It is a specific object of the present invention to provide a bed ruffle capable of being easily installed on a mattress foundation without requiring removal of the upper mattress.

It is another object of the invention to provide a bed ruffle that securely grips a mattress foundation and resists displacement of the bed ruffle from the desired position.

It is yet another object of the invention to provide a bed ruffle that allows for even adjustment of the vertical height of the ruffled skirt in order to accommodate bed frames and mattress foundations of different heights.

Still another object of the present invention is to provide a bed ruffle that can accommodate a range of bed sizes.

A further object of the present invention is to provide a simple bed ruffle construction which is economical to manufacture and durable in use.

These and other objects are achieved by the present invention which is embodied in a bed ruffle for covering and depending from the sides of a mattress foundation (e.g., box spring) and being capable of installation on the mattress foundation without removal of an upper mattress therefrom. The bed ruffle includes a band of elastically stretchable material forming a closed loop adapted to be stretched to pass over the upper mattress and grippingly retained on the sides of the mattress foundation with a top edge portion of the band extending over and elastically gripping a top edge of the mattress foundation, a lower edge portion extending under and elastically gripping a bottom edge of the mattress foundation, and a central portion covering and elastically gripping the sides of the mattress foundation. Attached to the band of material is a decorative skirt. The skirt covers at least a portion of the central portion of the band and extends downwardly beyond the central portion to at least partially cover the space between the mattress foundation and a supporting floor surface.

These and other objects, features and advantages will be fully appreciated and understood from the following detailed description of the preferred embodiments, taken in connection with the appended drawings.

DETAILED DESCRIPTION OF THE PREFERRED EMBODIMENTS

Figure 1:
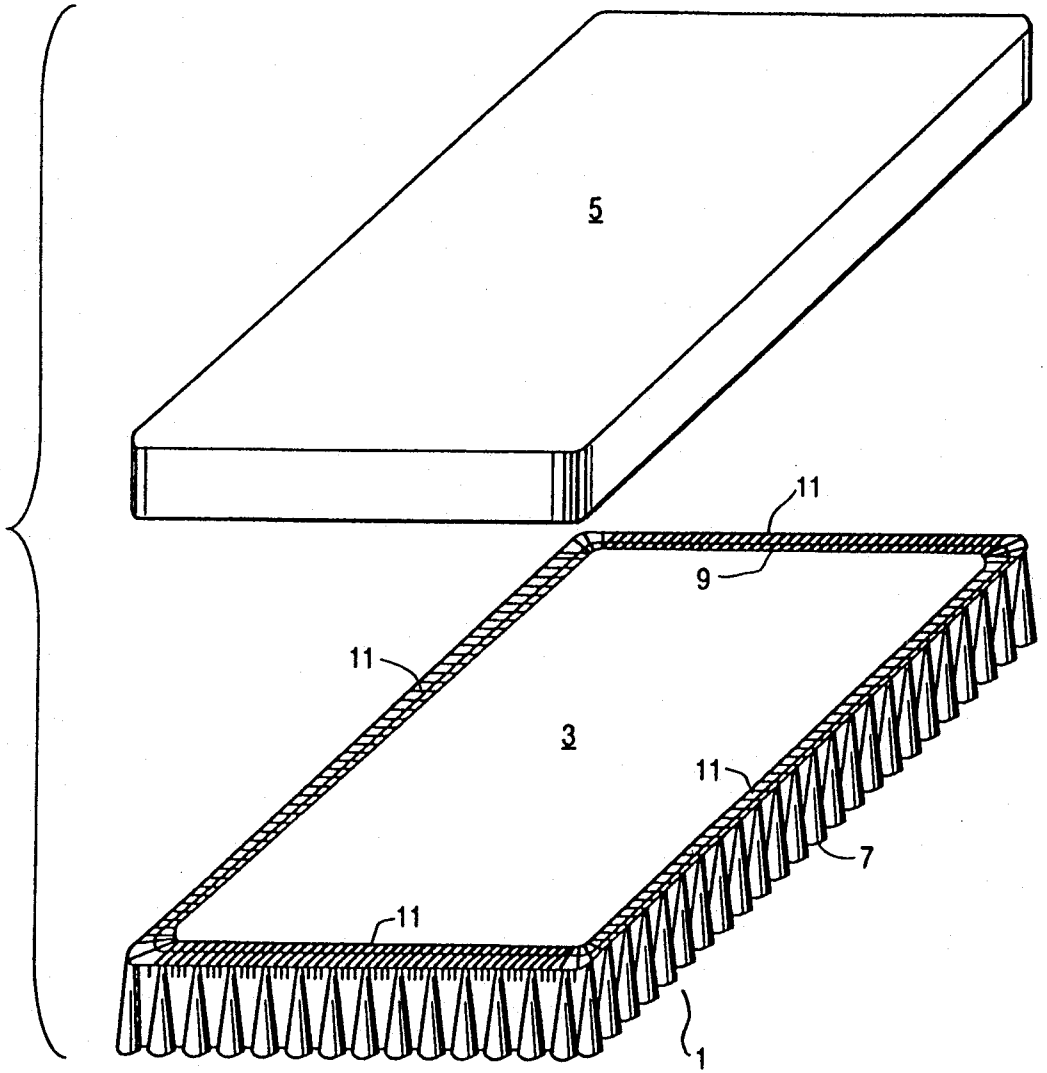
FIG. 1 is an exploded perspective view of a two piece mattress set, taken towards the top side and foot end thereof, with a bed ruffle in accordance with the present invention installed on the mattress foundation.
Figure 2:
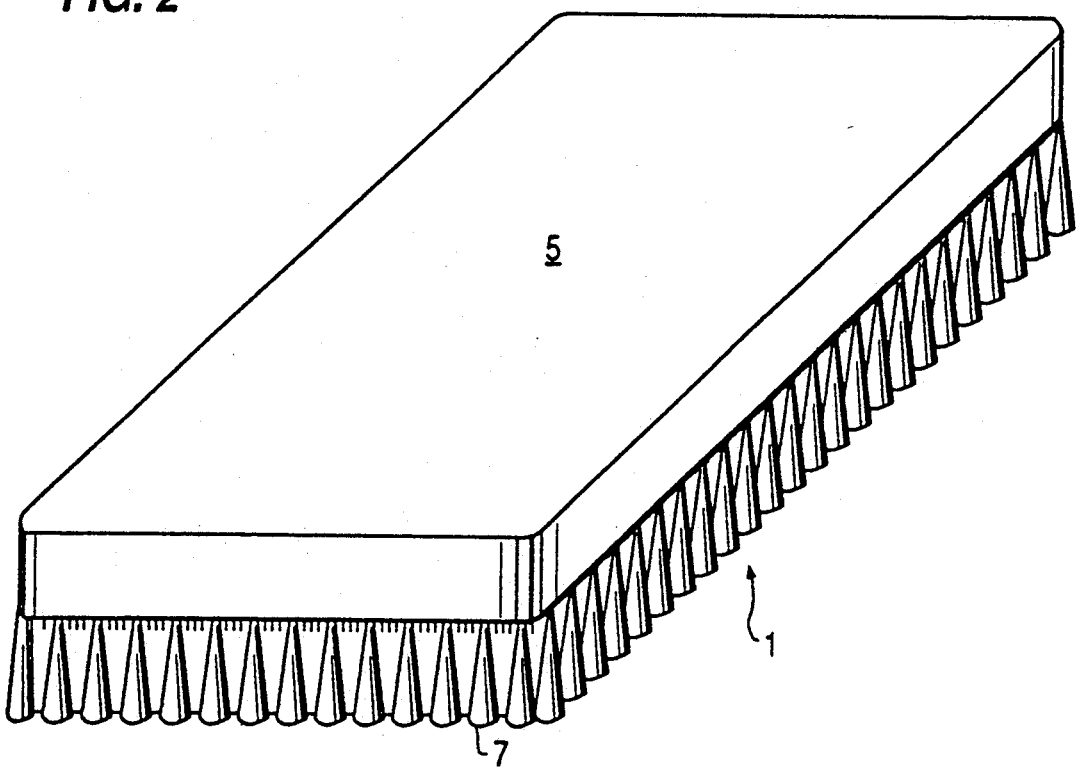
FIG. 2 is a perspective view of an assembled two piece mattress set, taken towards the top side and foot end thereof, having the inventive bed ruffle installed on the mattress foundation.

A bed ruffle 1 in accordance with the present invention is applied to a mattress foundation 3, such as a box spring or rigid support platform. Supported on the mattress foundation is a relatively soft upper mattress 5. Bed ruffle 1 comprises a decorative skirt 7 attached to and depending from a band of elastically stretchable material 9 forming a closed loop. Band 9 is adapted to be stretched to pass over the upper mattress and grippingly retained on the sides of the mattress. In this manner, bed ruffle 1 is capable of installation on foundation 3 without removal of upper mattress 5 from platform 3.

The width of band 9 is such that for a range of mattress thicknesses, a top edge portion 11 (FIG. 1) of band 9 will extend over and elastically grip a top edge of mattress foundation 3, a lower edge portion 13 (FIG. 3) will extend under and elastically grip a bottom edge of mattress foundation 3, and a central portion 15 (FIG. 3) will cover and elastically grip the sides of mattress foundation 3. This arrangement provides a sure grip of the bed ruffle on the foundation, whereby the bed ruffle will be much more resistant to displacements from its proper position.

Decorative skirt 7 is attached to band 9, such as by stitching, along a line generally corresponding to a division between top edge portion 11 and central portion 15. In this manner, decorative skirt 7 hangs in overlapping relation with band 9, and extends downwardly beyond the central portion to at least partially cover the space between mattress foundation 3 and a supporting floor surface. Since central portion 15 is covered by skirt 7, band 9 may be configured of a material displaying the required elasticity characteristics, without particular concern for aesthetics. Also, by attaching skirt 7 above lower edge portion 13, lower edge portion 13 is permitted to extend under the bottom edge of foundation 3 to be locked between the bed frame (not shown) and foundation 3, without interference with skirt 7. This further improves the retention of bed ruffle 1 on foundation 3.

Figure 3:
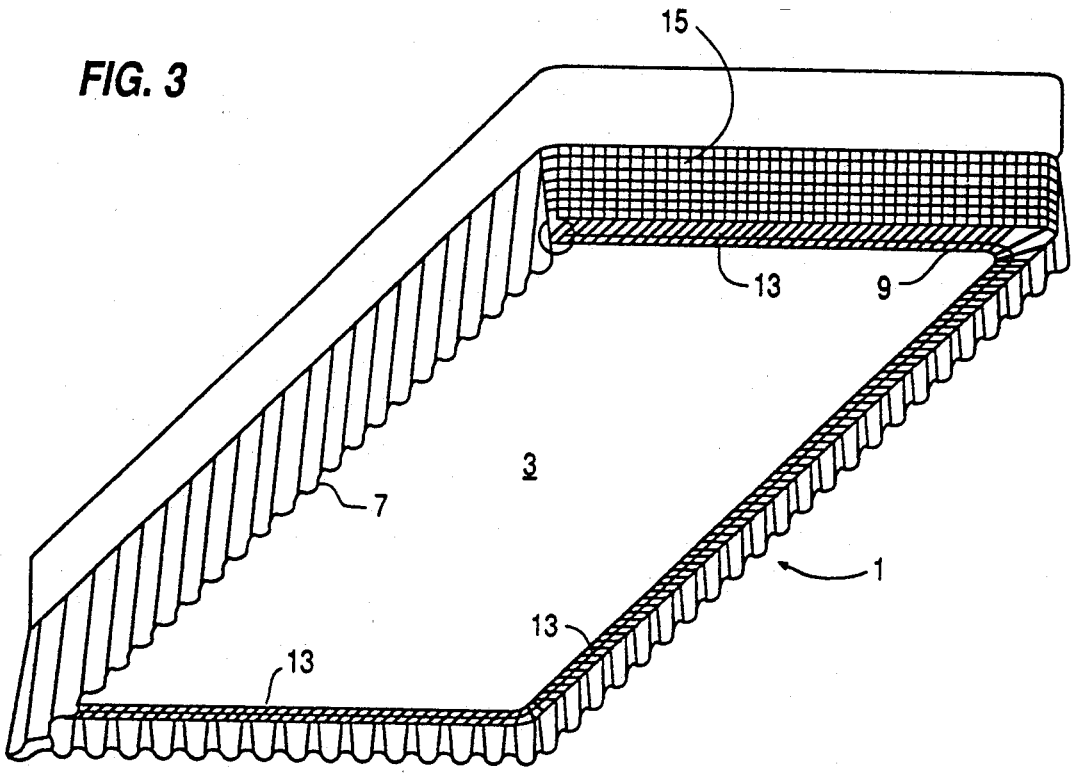
FIG. 3 is a perspective view of an assembled two piece mattress set, taken towards the bottom side and head end thereof, having the inventive bed ruffle installed on the mattress foundation.

The head of a bed is generally positioned against a wall, such that the head side of the foundation is not visible. Accordingly, as shown in FIG. 3, decorative skirt 7 may extend along less than the entire circumferential extend of band 9. In this manner, a gap in skirt 3 is provided such that skirt 3 does not extend completely across the head side of the mattress foundation.

Skirt 7 may comprise one or more of a variety of materials, depending upon the desired appearance and effect. In the preferred embodiment, skirt 7 comprises an inextensible fabric stitched to band 9 while band 9 is in a stretched condition, such that when band 9 is allowed to relax, gathers are formed along the upper edge of skirt 7. This provides an attractive ruffled appearance and keeps the inextensible skirt material from impeding elongation of band 9. Preferably, skirt 7 is stitched to band 9 in a gathered state such that the upper edge of skirt 7 remains gathered to a certain extend even when band 9 is stretched to its limit.

Band 9 is preferably constructed from a single continuous elongated strip of material exhibiting substantial elasticity in its longitudinal direction. The ends of the elongated strip are attached together to form an endless loop. This provides an extremely simple construction which is highly effective. Unlike the construction of the Morris patent mentioned in the background section, band 9 is uninterrupted along its length by fixed, e.g., mitered, corners provided to accommodate the corners of the mattress foundation. Additionally, the width of band 9 is uninterrupted by fixed edges provided to accommodate the top and bottom edges of the mattress foundation. In the preferred embodiment, top edge portion 11, bottom edge portion 13 and central portion 15 constitute undifferentiated parts of the continuous elongated strip of material forming band 9.

The sizes of top edge portion 11, bottom edge portion 13 and central portion 15 are determined by the thickness of the mattress foundation to which bed ruffle 1 is applied (box spring thicknesses generally vary between 7 and 8 inches), and the positioning of decorative skirt 7. Unlike the prior art, bed ruffle 1 is not limited to a certain foundation thickness, since it is unnecessary to match predetermined fixed edges of the securing means with corresponding upper and lower edges of the mattress. Rather, for a relatively thick foundation, the central portion can be increased in size with a concomitant reduction in the size of top and bottom edge portions 11, 13. Also, to adjust the drop of skirt 7, it is merely necessary to pull band 9 downwardly until the bottom edge of skirt 7 is at the desire height on each side, e.g., above or just touching the floor. In this connection, it will be apparent that the line of attachment of skirt 7 may become located below the aforementioned division of top edge portion 11 and central portion 15. If skirt 7 is pulled downwardly to provide a greater skirt drop, the upper part of central portion 15 above the attachment line of the skirt may be covered by overhanging sides of a comforter or the like to provide an aesthetically pleasing appearance. Alternatively, band 7 could be made of an inherently decorative material so that exposure of the band above the skirt would enhance rather than detract from the bed ruffle's appearance. While a conventional bed ruffle typically has a fixed drop of 14 inches, inventive bed ruffle 1 can, e.g., be adjusted to provide a skirt drop of between 14 and 16 inches.

Band 9 should be comprised of a material which exhibits the required elasticity in the longitudinal (circumferential) direction and provides a suitable base for attachment of skirt 7. The material should preferably also be able to withstand repeated machine washings and dryings while maintaining dimensional stability. Suitable materials include woven, non-woven and knitted fabrics. Such materials may be made inherently elastic by the incorporation of elastic threads therein, e.g., by replacing some or all of the machine direction or warp yarns with elastic yarns or threads. It is generally preferable to provide interspersed elastic and inelastic threads or yarns extending in the circumferential direction so that an excessive pulling force is not required in order to stretch bed ruffle 1 during installation thereof. In this case, the inelastic threads or yarns are gathered in between the elastic threads when band 9 is in a relaxed condition, such that the stretchability of band 9 is not impeded. Such materials may be made on stitch bonding machines, knitting machines or weaving machines/looms.

Preferably, band 9 is formed of a stretch knit material incorporating inelastic polyester yarns and interspersed polyester wrapped latex yarns extending in the circumferential direction of band 9. The particular knit should be chosen so as to avoid substantial "necking" when the material is stretched. That is, the material ought to be able to stretch to its limit without a substantial reduction in its width. This will ensure that band 9 has adequate width, when it is stretched, to cover the foundation sides and elastically wrap around the top and bottom edges of the foundation.

Band 9 could also comprise a strip of relatively inextensible base material which is gathered along its length by a plurality of spaced parallel elastic cords stitched into the material under tension. A suitable material of this type, and method of making the same, is described (in connection with a fitted mattress cover) in commonly owned Seago U.S. Pat. Nos. 4,985,953 and 5,056,441, which are hereby incorporated by reference.

Preferably, band 9 should be elastically stretchable to at least twice its original size. This will allow bed ruffle 1 to fit a range of mattress sizes, e.g., from twin to full or from queen to king.

The preferred procedure for installing bed ruffle 1 on mattress foundation 3 is now described. First, the "elastic-only" side of bed ruffle 1 (corresponding to the gap in skirt 7) is slipped over a corner of mattress 5 at the head of the bed and extended down over the head end corner of foundation 3. This corner of foundation 3 is then lifted to allow bottom edge portion 13 to be positioned and locked between foundation 3 and the bed frame (not shown). The elastic-only side is stretched tight along the head of the bed to the opposite corner, and then that corner of foundation 3 is lifted to once again lock lower edge portion 13 between foundation 3 and the bed frame. Bed ruffle 1 is then pulled down to the middle of the foot of the bed, and then hooked over both foot end corners of mattress 5. Bed ruffle 1 is then stretched over one of the two foot end corners of foundation 3 and locked between the bed frame and foundation 3 as previously described. Next, bed ruffle 1 is stretched over the remaining corner of foundation 3, and the locking step is repeated. Once bed ruffle 1 is installed, the drop of skirt 7 may be adjusted by pulling band 9 downwardly along each side.

The present invention has been described in terms of preferred embodiments thereof. The invention is not limited to these particular embodiments, but rather extends to all other embodiments and variations within the scope of the appended claims and the applicable ranges of equivalents.

We claim:

1. A bed ruffle for covering and depending from the sides of a mattress foundation and being capable of installation on said mattress foundation without removal of an upper mattress therefrom, said bed ruffle comprising:

a band of elastically stretchable material forming a closed loop adapted to be stretched to pass over said upper mattress and grippingly retained on the sides of said mattress foundation with: a top edge portion of the band extending over and elastically gripping a top edge of said mattress foundation; a lower edge portion extending under and elastically gripping a bottom edge of said mattress foundation; and a central portion covering and elastically gripping said sides of the mattress foundation; and a decorative skirt attached to said band of material in overlapping relation therewith, for covering at least part of said central portion and extending downwardly beyond said central portion to at least partially cover the space between said mattress foundation and a supporting floor surface.

2. A bed ruffle according to claim 1, wherein said band of elastically stretchable material comprises a stretch knit material.

3. A bed ruffle according to claim 3, wherein said stretch knit material incorporates elastic threads or yarns extending in a circumferential direction of the band.

4. A bed ruffle according to claim 3, wherein said stretch knit material further incorporates inelastic threads or yarns extending in said circumferential direction between said elastic threads.

5. A bed ruffle according to claim 1, wherein said top edge portion, lower edge portion and central portion constitute undifferentiated parts of a single strip of elastically stretchable material forming said band.

6. A bed ruffle according to claim 1, wherein said ruffle material extends along less than the entire circumferential extent of said band, a gap free of said ruffle material being provided such that said ruffle material does not extend along a head end of said mattress foundation.

7. A bed ruffle according to claim 1, wherein said ruffle material is attached along a line generally corresponding to a division between said top edge portion and central portion.

8. A bed ruffle according to claim 1, wherein the length of said band is uninterrupted by fixed corners provided to accommodate the corners of the mattress foundation.

9. A bed ruffle according to claim 8, wherein the width of said band is uninterrupted by fixed edges provided to accommodate the top and bottom edges of the mattress foundation.

* * * * *